United States Patent [19]

Davidson

[11] Patent Number: 4,676,881

[45] Date of Patent: Jun. 30, 1987

[54] ELECTROCOATING CELL

[75] Inventor: John J. Davidson, New Kensington, Pa.

[73] Assignee: Aluminum Company of America, Pittsburgh, Pa.

[21] Appl. No.: 817,870

[22] Filed: Jan. 13, 1986

[51] Int. Cl.[4] ..... C25D 17/00; C25D 13/12; C25D 13/00; C25B 9/00

[52] U.S. Cl. ..... 204/212; 204/272; 204/284; 204/300 EC

[58] Field of Search ..... 204/299 EC, 300 EC, 204/272, 212, 284

[56] References Cited

U.S. PATENT DOCUMENTS

| | | | |
|---|---|---|---|
| 2,236,861 | 4/1941 | Widell | 204/300 EC |
| 4,094,760 | 6/1978 | Smith et al. | 204/300 EC X |
| 4,107,016 | 8/1978 | Brower et al. | 204/300 EC X |
| 4,210,507 | 7/1980 | Davidson et al. | 204/300 EC X |
| 4,246,088 | 1/1981 | Murphy et al. | 204/272 X |
| 4,400,251 | 8/1983 | Heffner et al. | 204/299 EC X |
| 4,515,677 | 5/1985 | Heathcoat et al. | 204/299 EC X |

*Primary Examiner*—Donald R. Valentine

*Attorney, Agent, or Firm*—Elroy Strickland; J. Stewart Brams

[57] ABSTRACT

An electrocoating cell preferably for use in a rotary turret machine for electrocoating a container or the like in an upright orientation, wherein all requisite coating medium inlet connections and electrical connections to the cell, as well as both the inner and outer electrodes, are carried by a single vertically movable cell assembly, preferably the upper part of the cell, which cooperates with a relatively vertically stationary cell base that carries the upright container.

12 Claims, 2 Drawing Figures

ELECTROCOATING CELL

BACKGROUND OF THE INVENTION

Figure 1:
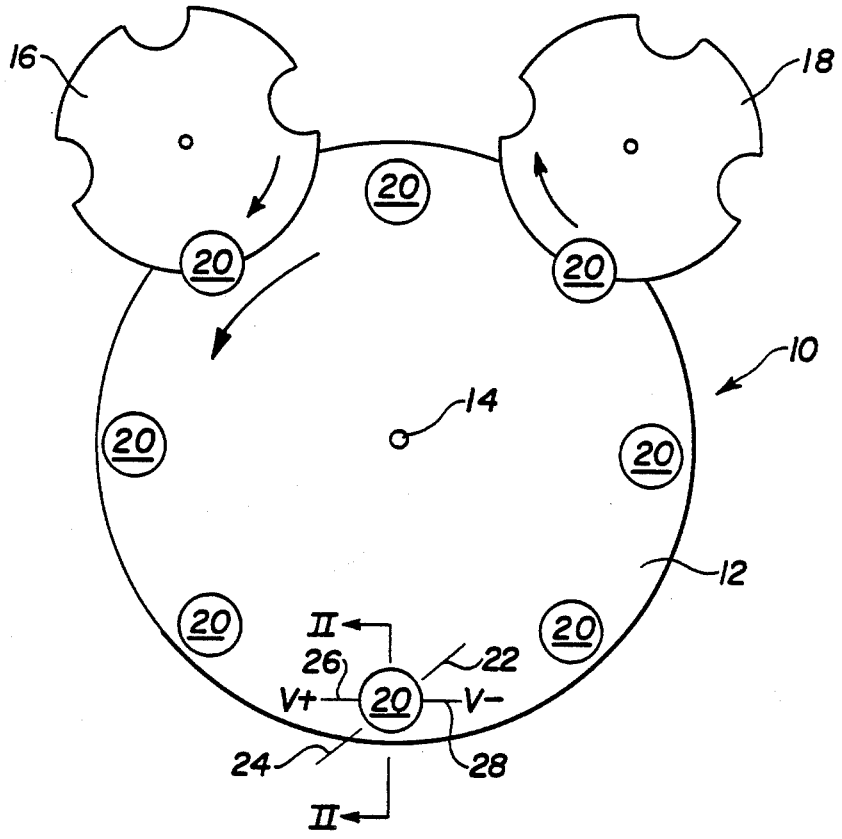

In the art of container coating it is well known to coat both the interior and exterior surface areas of a metal can made of aluminum, steel or tin plate steel for example. Known coating materials and methods have included the spray coating of containers with conventional paints and electrophoretic coating of containers with such coatings as water-based or water dispersible resinous coating materials. This invention concerns apparatus for the electrodeposition of such materials on electrically conductive surface areas of a metal can from either anodic or cathodic electrocoating material or media.

Typically in the electrocoating art, the metal can is confined in a cell which is then filled with a continuous flow of coating material, and a layer of particulate coating material is then electro-deposited on the electrically charged metal surfaces of the can as a result of an electrical potential difference maintained between the can and the oppositely charged electrodes. The prior art includes among numerous examples of electrocoating technology, U.S. Pat. Nos. 3,476,667; 3,922,213; 4,094,760 and 4,210,507.

Inasmuch as electrocoating of containers as discussed hereinabove and disclosed in the cited prior art patents is well known, further detailed description thereof is not necessary for an understanding of the present invention and therefore is included hereinafter only as necessary for describing the invention. Such known electrocoating apparatus often has comprised rotary turret type machines that are employed for handling metal containers for the cleansing and coating thereof during can manufacture. Examples of rotary turret machines generally, for use in handling of containers for processing and for packaging of products therein include U.S. Pat. Nos. 3,476,666; 4,026,311; 4,158,405 and 4,246,088, and British Pat. No. 1,571,808 all disclose such apparatus U.S. Pat. Nos. 3,476,666 and 4,246,088 in particular disclose the use of rotary turret type apparatus in the processing of metal cans which includes such electrically operative treatment of cans as electrolytic surface treatment and electrodeposition of protective coating materials thereon.

In many prior rotary turret type machines for electrocoating of containers, each of the containers to be coated is carried in one of the plurality of cells which are positioned about a pitch circle that is coaxial with the axis of rotation of the turret machine. Accordingly, a loading station and a discharge station must also be provided, as well as other ancillary container handling apparatus well known in the art.

Conventional rotary turret machines typically have cells comprised of upper and lower vertically movable cell portions, and an intervening can support portion which supports a can in an inverted orientation. The difficulty of providing all of the requisite electrical and fluid connections to such cells for the electrocoating process significantly impacts the complexity of the apparatus, and therefore its cost, without any compensating benefit. Each such cell of the rotary turret machine must be provided with fluid supply connections to supply a flow of electrocoating medium to all areas of the can's surface, usually including both interior and exterior surface areas, and an exhaust channel to maintain the flow of coating material during the coating cycle and to drain away residual coating material at the end of the coating cycle. Additionally, motive means such as a mechanical rise and fall cam must be provided to open and close each vertically moving portion of each cell as required during the machine operating cycle. Still further, electrical connections for the impression of an electrical potential difference between the container to be coated and the oppositely charged electrodes must be provided for each vertically movable portion of the cell.

As a rotary turret type machine requires phased operation of the individual cells according to the position of each cell on the circumference of the turret at any given time, all of the cell cycle timing and the necessary control of the electrocoating material supply and exhaust, electrical connections, cell opening and closing mechanisms, and all of the other operative entities required in the electrocoating process must be similarly phased to provide the proper cyclic operation for each cell. This requirement has resulted in enormously complex apparatus.

The more complex a machine is, generally the more expensive and less reliable it will be than a simpler design of comparable capability. The phased relationship of the cell operating cycles in rotary turret type electrocoating machines introduces considerable complexity of mechanical design and control as the cells operate neither in unison or in a distinct sequence of repetitive non-overlapping cycles. For the above and other reasons, known rotary turret type electrocoating apparatus has not proven to be entirely satisfactory, although its acceptance and use is nevertheless widespread.

Other related problems have been evident in the prior art. For example, gravity and the high speed rotation of rotary turret type machines tend to direct leakage of electrocoating material from the cell closure interface radially outward and downward where it may foul electrical commutators and brushes, the lower cell portion rise and fall cam, or other components located on or near the circumferential perimeter of the machine and below the interface between the upper and lower cell portions.

Apart from the above and other problems of prior rotary turret machines, prior electrocoating cells have been subject to certain limitations irrespective of the type of apparatus in which they are incorporated. For example, practitioners of the art have continuously sought to minimize coating cycle time, or in other words to maximize coated can production rates. The rate of coating deposition on the can is one of several critical factors that determine minimum cycle time. Coating deposition rate is in turn a function of several design and operating perameters including the percentage of resin in the coating bath, the applied electrical potential difference between the can and adjacent electrodes, and the can-to-electrode spacing. As a result, several critical design parameters of conventional electrocoating cells often have come into direct conflict and have impeded efforts to maximize production rates.

For example, it has been suggested that improvements in electrocoating cycle times might be achieved by placing the electrode in very close proximity to the can surface to be coated; however, this would narrow the coating medium flow channel between the can surface and the electrode and therefore reduce the cross-sectional flow area of the channel. The resulting restriction in coating medium flow would introduce a higher pressure drop through the flow channel and would therefore require more motive force to maintain the same level of coating medium flow. Furthermore, with such a flow channel cross-section reduction, the reservoir volume available for coating medium is reduced and the coating medium flow rate thus would have to be increased to offset the reduced availability of fresh coating medium within the cell. Failure to do this could well result in resin starvation in the coating medium and consequent reduced electrodeposition rates. A related concern is that significant reductions in flow channel cross-sectional area and increased electrocoating medium pressures of flow rates will tend to promote fluid turbulance in the coating medium flow and inhibit the coating process.

Thus it will be appreciated that maximized electrodeposition rates at minimum cost requires minimum effective electrical potential, minimum can-to-electrode spacing, elimination of coating medium flow turbulence, minimizing of coating medium flow channel restrictions, minimal effective flow pressures, and maintenance of a sufficient volume of fresh coating medium at all times. Due to the perceived interdependence of these conditions in the prior art, every prior cell design known to applicant has been at best a design compromise of limited success.

BRIEF SUMMARY OF THE INVENTION

The present invention alleviates the above and other shortcomings of the prior art to provide an electrocating cell of simplified design and improved efficiency, which offers enhanced reliability and ease of maintenance for rotary turret type electrocoating machines. The invention also offers prospects for improved efficiency of metal can electrocoating processes in general by providing for significant reductions in electrocoating cycle time without incurring any offsetting cost penalties.

Briefly, the invention in one embodiment pertains to a novel electrocoating cell, preferably for use in a rotary turret type machine, and comprising a nest or support portion carried by a lower platen and which in turn carries a can in an upright orientation. An upper, vertically movable cell portion is carried by an upper platen and comprises both the inner and outer electrodes which reside adjacent the can interior and exterior sidewalls, respectively, when the cell is closed. The upper cell portion also includes the coating medium flow inlets and most of the flow passages. Accordingly, all of the requisite electrical connections and all fluid inlet connections are connected and secured with respect to the upper platen of the rotary turret machine. Furthermore, only a single rise and fall cam is required since the cell comprises only two relatively vertically moving elements, and of those one may remain vertically stationary while the other is moved vertically with respect to it.

Another embodiment of the invention comprises an electrocoating cell wherein the inner and outer electrodes are coaxial, cylindrical members carried by a single cell component and are stationary with respect to each other. The cell is generally an open ended cylinder which receives an open ended cylindrical can therein within the annular space defined between the inner and outer electrodes. (Of course, the invention is not intended to be limited to cylindrical cans.) The inner and outer electrodes are formed of perforated electrically conductive sheet material and the reservoir for coating medium within the cell comprises spaces on both sides of each such electrode with fluid flow communication between the opposite sides of the electrode being maintained through the perforations in the electrode sheet. In a cell without such electrode perforations, the coating medium must flow through long, narrow spaces between the can and the cell electrodes. This restricts coating medium flow and may result in resin depletion in the coating medium. The perforations provided in the cell electrodes of this invention allow the can and electrodes to be close together while simultaneously permitting fresh coating material to be delivered easily to the can surface.

The invention thus provides for improved efficiency of electrocoating processes and simplicity and economy in electrocoating machine design. More specifically, the invention simplifies rotary machine design, reduces the down time necessary for cleanup, decreases coating cell fill time, decreases the volt cycle time, and reduces the overall size of the rotary machine, among other advantages.

It is therefore one general object of the invention to provide a novel and improved electrocoating cell.

A more specific object of the invention is to provide an electrocoating cell comprised of only two relatively vertically movable cell elements in which all requisite electrical connections and electrocoating medium fluid supply lines are connected to a single one of the two cell elements.

Another object of the invention is to provide an electrocoating cell with novel electrode and coating medium flow channel and reservoir configurations.

Figure 2:
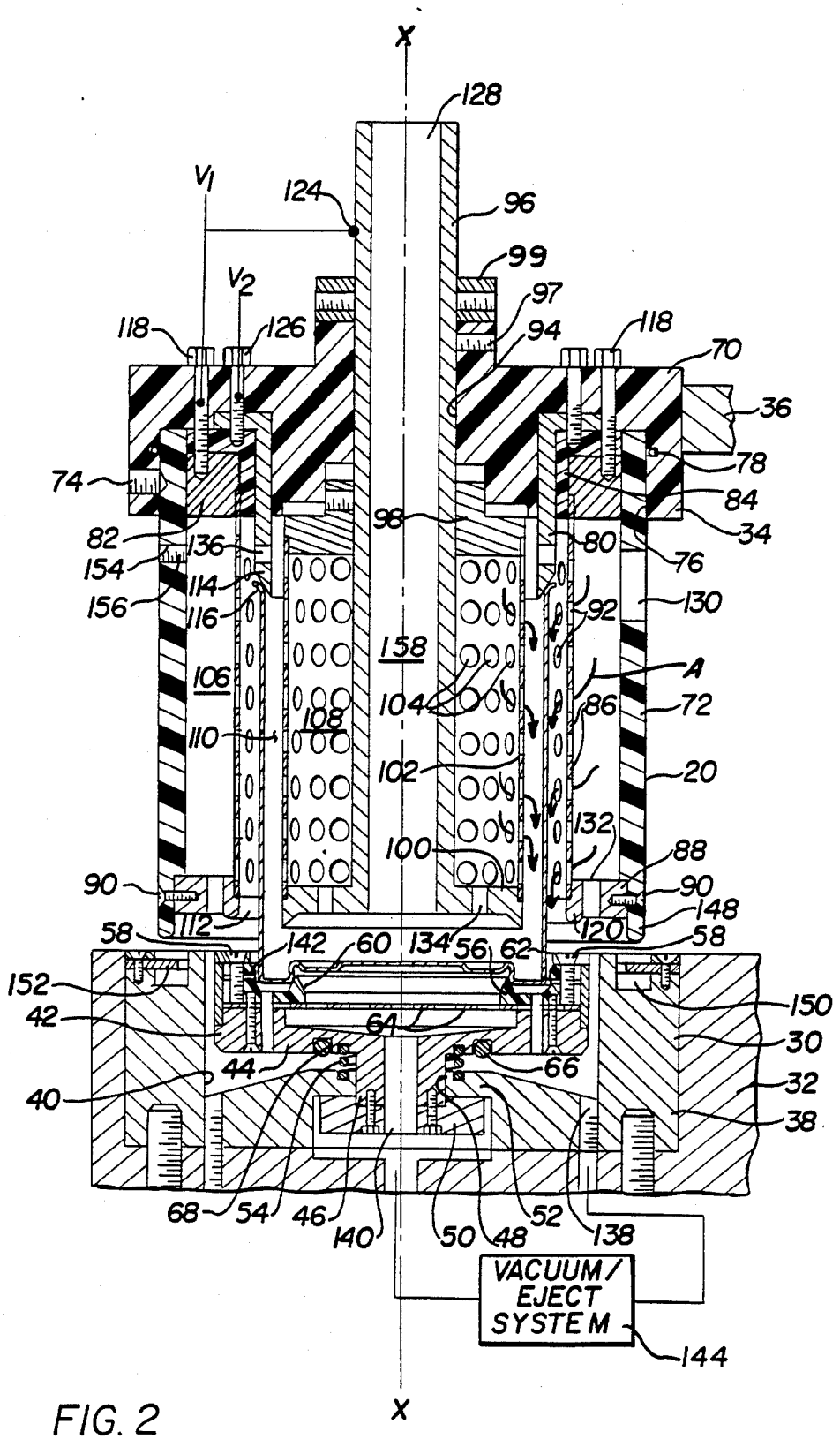

These and other objects and further advantages of the invention will be more readily understood upon consideration of the following detailed description and the accompanying drawings, in which:

FIG. 1 is a simplified schematic top plan view of a rotary turret type electrocoating apparatus according to the instant invention; and FIG. 2 is a transverse section of an electrocoating cell of the present invention taken on line II—II of FIG. 1.

There is generally indicated at 10 in FIG. 1 a rotary turret type electrocoating apparatus according to one presently preferred embodiment of the instant invention. It will be understood that FIG. 1 is an extremely simplified schematic illustration showing only a turret 12 which is rotatable on an axis 14 in coordination with a rotary feed mechanism 16, a star wheel device for example, and a similar rotary discharge mechanism 18. The feed 16 and discharge 18 are operative to feed metal containers (not shown) in a continuous sequence to a plurality of electrocoating cells 20 which are carried at spaced locations about the periphery of turret 12. The coordinated rotary motion of turret 12, feed 16 and discharge 18 thus provides for the electrocoating of such a continuous sequence of metal containers by feeding the containers one by one into cells 20, as is well known, for electrocoating thereof as the cells progress in continuous repeated sequence from feed 16 to discharge 18.

In general, each cell 20 is provided with a coating medium feed flow conduit 22 and a coating medium drain 24, as well as positive and negative voltage connections 26, 28, respectively, which are utilized to impress the requisite electrical potential difference between the electrodes in cells 20 and the container to be coated.

The above description pertains to elements of a conventional rotary turret type electrocoating apparatus which form no part of the instant invention. It is included purely for purposes of descriptive clarity, and further detailed description of such conventional apparatus is unnecessary for an understanding of the present invention. It will be appreciated that in its broadest aspect the invention may be used independently of such a rotary turret type apparatus.

Referring to FIG. 2, cell 20, which is but one of a plurality of identical cells in a rotary turret machine, will be seen to comprise a lower container supporting portion 30 which is carried by a lower platen portion 32 of turret 12 and is continuously maintained in coaxial alignment with an upper container end closing portion 34 of cell 20 that is carried by an upper platen portion 36 of turret 12.

Cell portion 30 includes a base member 38 having a central, upwardly open, formed counterbore or relief 40 within which is received a container nest assembly 42. Nest assembly 42 includes a body member 44 having a downwardly projecting stem portion 46 which projects through a reduced diameter portion 48 of counterbore 40 to receive a retention plate 50. The bore portion 48 is formed by a radially inwardly projecting flange portion 52 of base 38 such that nest portion 42 is captively retained with the body member 44 above flange 52 and retention plate 50 beneath flange 52.

Nest portion 42 further comprises an annular, electrically insulating container nest member 56 which is releasably affixed atop body member 44 as by screws 58. An annular upwardly facing formed container receiving surface portion 60 of member 56 is configured to supportingly engage the bottom of a container 62, which is to be electrocoated, for supporting the container 62 in cell 20. For electrocoating the exterior bottom surface of container 62, an electrode 64 is located intermediate nest member 56 and the nest portion body member 44 to which member 56 is affixed.

A coil spring 54 encompasses stem 46 intermediate the body member 44 and flange 52 to continuously bias nest portion 42 upwardly to the limiting position whereat retention plate 50 engages the underside of flange 52. A resilient O-ring seal 66 resides in a downwardly open annular groove 68 that is formed in the lower surface of body 44 in coaxially encompassing relationship with spring 54. Accordingly, upon application of downward force sufficient to overcome the bias of spring 54, nest portion 42 is vertically movable from its extreme uppermost position, as shown, to a lower position whereat seal 66 sealingly engages the upper side of flange 52.

The upper portion 34 of cell 20 comprises an electrical insulating base or body member 70 having a nonconductive, elongated cylindrical skirt 72 which depends downwardly therefrom and is affixed thereto as by one or more set screws 74 or other suitable securing means. As shown, skirt 72 is received into a radially outer portion of a formed annular groove 76 in the underside of body member 70. Other elements secured within groove 76 include an O-ring seal 78 located radially intermediate skirt 72 and the radially outer perimeter of groove 76, and an annular can contactor skirt element 80 located adjacent the radially inner perimeter of groove 76 and depending downwardly therefrom. Intermediate can contactor element 80 and skirt 72 within groove 76 is an outer electrode support ring 82 which is electrically insulated from can contactor 80 by an intervening insulator ring 84.

A cylindrical outer electrode 86 is electrically connected to and supported by ring 82 and depends downwardly therefrom. Adjacent its lower end, electrode 86 is electrically connected to and supported by a conductive lower support ring 88 which is in turn supported within the lower extent of skirt 72 as by screws 90. The electrode 86 is comprised of conductive, thin section sheet form material formed as a cylinder and perforated with openings 92 uniformly throughout its length and circumference. Preferably the ratio of perforation area to intervening surface area is about 1:1.

A central axial through bore 94 in body member 70 receives an elongated hollow conductive stem 96 which has a pair of axially spaced radially projecting flange or collar portions 98, 100, which may be either separate collars affaixed to stem 96 as shown for collar 98, or an integral part of stem 96 as shown for collar 100. Collar 100 is located adjacent the lower open end of stem 96 and collar 98 is spaced upwardly therefrom such that both collars 98 and 100 reside beneath base 70 and the upper end of stem 96 projects within bore 94 and upwardly of base 70. Stem 96 is axially supported with respect to base 70 as by a set screw 97 and/or an adjustable collar 99.

A cylindrical inner electrode 102 extends coaxially intermediate collars 98 and 100 and is electrically connected thereto and supported thereby. Like electrode 86, inner electrode 102 is comprised of conductive, thin section sheet form material formed as a cylinder and perforated with openings 104 to achieve a 1:1 perforation area to surface area ratio.

In the overall structure of upper cell portion 34, the major elements thereof as above described are affixed in coaxially nested relationship by direct or indirect attachment to their common base 70. The arrangement of the major elements, beginning at the cell axis X—X and moving radially outward therefrom, comprises stem 96, electrode 102, can contactor 80, electrode 86, and skirt 72. An annular space or cavity is defined radially intermediate each pair of adjacent coaxial elements as above described. Thus, an outer coating medium reservoir portion 106 is located radially intermediate skirt 72 and outer electrode 86 while another such reservoir portion 108 is located radially intermediate stem 96 and electrode 102. Similarly, the electrodes 86 and 102 are spaced radially apart to define a cylindrical can receiving space 110 having a lower open end 112 and having the can contactor 80 projecting downwardly from the upper end thereof in radially spaced relationship with both electrodes 86 and 102.

A formed lower end portion 114 of can contactor 80 is effective for electrical engagement with the upper end lip 116 of can 62, which is received in upright orientation within can receiving space 110. The support of can 62 upon surface 60 of nest member 56, together with the supporting contact of contactor end portion 114, serves to securely position the can 62 within cell 20 in spaced relationship with respect to electrodes 86, 102 and 64 for electrocoating thereof by electrocoating medium which fills the interior spaces of cell 20 as below described.

Operation of cell 20 for electrocoating requires conventional electrical potential inputs as well as a supply of suitable electrocoating medium. Accordingly, screw terminals 118 are provided to retain electrode support ring 82 within groove 76 and to provide the requisite electrical connection of a voltage source $V_1$ to electrode 86. When cell 20 is closed, a lower end portion 120 of support ring 88 electrically engages bottom electrode 64, by contact with screws 58 for example, to provide voltage to electrode 64 as well. Voltage source $V_1$ is also connected to the conductive stem 96 as at 124 to provide voltage $V_1$ via stem 96 and collars 98, 100 to electrode 102. The insulating properties of base member 70 and insulator ring 84 serve to isolate can contactor 80 from voltage source $V_1$.

As is well known, electrocoating processes require voltages of opposite polarity to be impressed upon the electrode and the container being coated. Accordingly, a voltage source $V_2$ of opposite polarity to source $V_1$ is connected by a screw terminal 126 to can contactor 80 whereby upon contact thereof with the rim of can 62 a suitable electrical potential may be provided to can 62.

To provide the requisite volume of electrocoating medium, any suitable and well known coating medium source (not shown) is connected via a suitable flow conduit (not shown) to a cell inlet opening such as the upper end 128 of stem 96 or a radial through bore 130 formed in outer skirt 72. From these entry points the coating medium flows via ports such as the perforations 92 and 104 in the electrodes, and via supplemental ports such as bores 132 in support ring 88, bores 134 in collar 100, and bores 136 in can contactor 80, to completly fill the interior volume of cell 20 as will be described hereinbelow. Depending upon the mode of coating medium flow chosen, suitable drain ports may also be provided, as at 138 and/or 140 for example, to drain coating medium from the cell 20.

A novel and improved rotary turret type electrocoating machine, and a novel and improved electrocoating cell are thus provided. The cell 20 has only two sections which serve to support and enclose a can for electrocoating thereof. The cell opening and closing operation therefore may be readily achieved by a single conventional rise and fall camming device (not shown) as only one part of the cell needs to move vertically while the other may remain stationary. Another significant design simplification results from the possibility with this cell of making all requisite fluid and electrical connections to one of the two separable cell parts. Preferably this will be the upper cell part 34 as described, and upper cell part 34 would also preferably be the vertically movable cell part that is actuated by the rise and fall cam. Accordingly, a great deal of the operating gear associated with each cell, including inter alia the rise and fall cam and the necessary electrical contact brushes and comutators, would be positioned above the closure interface between the upper and lower cell parts thereby greatly enhancing operational reliability and simplifying maintenance since any leakage from the cell closure interface would be directed by gravity away from the critical operating gear.

Operation of the cell 20 is described below with reference to three distinct modes of coating medium flow. In each mode, with cell 20 open, a can 62 is first positioned upright on nest member 56 and retained thereon as by circumferentially spaced spring bias engagement members such as at 142 which project radially inwardly to engage the lower outer perimeter of can 62. A vacuum system 144, operable through ports 138 and/or 140 for example, may supplement or replace members 142 for retention of can 62. Combined with or separate from vacuum system 144 there may be an air pressure ejection system which operates through the same ports as the vacuum system to eject can 62 from the cell upon completion of the electrocoating cycle. With a can 62 in place, the cell upper portion 34 is lowered over can 62 to enclose the can sidewalls within the annular space 110 between electrodes 86 and 102. As upper cell portion 34 is lowered, the lower end 114 of contactor 80 engages lip 116 of can 62 and exerts a downward bias, thus moving can 62 and nest member 56 downwardly against the bias of spring 54 until the lower end 148 of skirt 72 enters a cooperating closure groove 150 on the lower cell portion 30 and engages a closure seal member 152 which projects radially to at least partially cover groove 150.

With cell 20 closed, one of the three modes of coating medium flow is initiated. In one mode, a flow option referred to as fill-only is utilized to introduce the coating medium, preferably via either port 128 or port 130. The coating medium then flows via the above described ports and electrode perforations within the cell 20 to completely immerse can 62. An overflow port 154 has a plug 156 which may be removed to accommodate overflow of coating medium in the fill-only mode. With fill-only, the coating medium is not flowing during the electrocoating process and flow turbulence therefore is not a concern as a potential inhibiter of the coating action. The volume of coating material in the cell is sufficient to insure that the process can be taken to completion without experiencing resin starvation in the coating medium. Due to the perforations 92 and 104, a large volume of fresh coating medium is continuously available throughout the coating process even though the can-to-electrode spacing is smaller than usual and the volume of coating medium residing between the can and the electrodes at any given time is also smaller than usual. These factors, the absence of significant flow turbulence, minimal electrode-to-can spacing, and ample volume of electrocoating medium permit very rapid coating and thus sharply reduced machine cycle times.

In a second mode of electrocoating, referred to as mono-flow, the coating medium is directed from a single inlet port such as 128 or 130 via a continuous flow path through the cell 20 and thence via a drain port such as at 138 from the cell. For example, coating medium may be introduced at port 130 to flow in a continuous stream via ports 132 and perforations 92 into the space adjacent the outer perimeter of can 62, thence via ports 136 in contactor 80 to the space adjacent the inner periphery of can 62, through perforations 104 into space 108, and finally via ports 134 and the hollow interior 158 of stem 96 to be exhausted through port 128 at the top of stem 96.

With the mono-flow option, the benefits of large coating medium volume and close electrode-to-can spacing are maintained, and as a result of the large volume, the coating medium flow rate may be minimized. This helps to avoid excessive flow turbulance within the cell.

The third flow option is referred to as duo-flow and is similar to the mono-flow option with regard to the benefits of reduced flow rates, reduced turbulence, maximum coating medium volume, and minimized electrode-to-can spacing. The duo-flow option is distinguished from the mono-flow option in that multiple flow paths (rather than a single flow path) are maintained for coating medium flow within the cell.

For any of the flow options, the electrical potential difference imposed between can 62 and the adjacent electrodes drives the electrocoating process, as is well known, to produce a coated can. However, it is believed that the perforations in the electrodes and the electrical field cooperates to promote material migration within the mass of electrocoating medium in the cell during the electrocoating process in a manner to assist in driving fresh coating medium through the perforations and into the zone between the respective electrodes and the can sidewalls, for example as indicated by arrows A in FIG. 2. Although the precise mechanism by which this occurs is not well understood, it is believed to be a necessary result of the cell operation as the spacing between the can and the electrodes is not large enough to contain sufficient coating medium to successfully complete a coating operation without resin starvation.

According to the description hereinabove, the present invention offers numerous advantages and improvements over prior electrocoating cells with the result that the electrocoating process cycle time may be reduced significantly. The consequent increased production rates and increased energy and material use efficiency result in significantly enhanced productivity, especially in the use of rotary turret type machines.

Of course, the inventor has contemplated various alternatives and modified embodiments which it is believed would readily occur to others versed in the art, having once been apprised of this invention. Accordingly, it is intended that the invention be construed broadly and limited only by the scope of the claims appended hereto.

I claim:

1. In a rotary turret apparatus for electrocoating hollow, open-ended metal objects wherein the apparatus comprises a rotatable turret which carries a plurality of electrocoating cells for rotary movement in repetitive cycles from a feed station to a discharge station such that a sequence of such metal objects is received in a respective sequence of cells at the feed station with the metal objects being enclosed in the respective cells for electrocoating thereof as the respective cells move in concert with turret rotation from the feed station toward the discharge station where the electrocoated metal objects are discharged from the respective cells in sequence, and wherein at least some of said electrocoating cells include a first cell portion with a base portion which supportingly engages one end of such a metal object and a second cell portion which is cooperable with said first portion to enclose such a metal object within said cell with said first and second cell portions being mounted on said rotary turret machine for relative movement with respect to each other to selectively open and close said cells, the improvement comprising: said first cell portion being substantially stationary with respect to said turret and said second cell portion vertically overlying said first cell portion and being movable axially toward and away from said first cell portion during closing and opening, respectively of said cell, and, said second cell portion including formed interior and exterior electrode means which move in unison into positions adjacent the respective interior and exterior sidewall portions of said metal object as said cell is closed to provide electrode structures for electrocoating of substantially the entire interior and exterior sidewall areas of such each metal object.

2. The improvement as claimed in claim 1 wherein said base portion supports such a metal object with an open end of such metal object opening vertically upwardly.

3. The improvement as claimed in claim 2 additionally including electrocoating medium inlet means in said second cell portion.

4. The improvement as claimed in claim 3 additionally including opposite polarity voltage connections in said second cell portion to provide opposite polarity electrical potential to said electrodes and such a metal object, respectively.

5. The improvement as claimed in claim 4 additionally including a bottom electrode underlying said base portion and electrical connection means adjacent the juncture between said first and second cell portions to provide electrical potential to said bottom electrode.

6. In an electrocoating cell for electrocoating generally cylindrical, open-ended metal objects, the combination comprising:

a pair of axially disposed cell portions which are relatively axially movable into and out of engagement with each other to close and open said cell;

one of said cell portions including a base member for support of such a metal object with an open end thereof extending transversely of said axis;

the other of said cell portions including a body member and generally cylindrical, coaxially disposed interior and exterior electrode means projecting therefrom toward said base member of said one cell portion;

said interior and exterior electrode means being positioned to define radially therebetween a generally annular object receiving space for receiving such a generally cylindrical metal object such that said exterior electrode means is positioned adjacent exterior sidewall portions of such metal object and said interior electrode means projects into such an open end of such metal object and is positioned adjacent interior sidewall portions thereof;

an exterior skirt encompassing said interior and exterior electrode means;

reservoir spaces for containing electrocoating medium defined radially intermediate with skirt and said exterior electrode means, radially intermediate said exterior and interior electrode means within said annular object receiving space, and radially inwardly of said interior electrode means; and said interior and exterior electrode means having perforated surface portions for fluid communication between the respective said reservoir spaces on opposite sides of each said electrode.

7. The combination as claimed in claim 6 wherein said perforations are substantially uniformly distributed over the surface area of each said electrode.

8. The combination as claimed in claim 7 wherein the ratio of perforation area to surface area of each said electrode is approximately 1:1.

9. The combination as claimed in claim 8 wherein said perforations are circular perforations.

10. The combination as claimed in claim 6 additionally including opposite polarity electrical connections to said interior and exterior electrodes and to such a metal object, respectively, in said other cell portion.

11. The combination as claimed in claim 10 additionally including electrocoating medium inlet means in said other cell portion.

12. In an electrocoating cell for electrocoating of generally cylindrical metal objects, the improvement comprising:

generally cylindrical interior and exterior electrodes located coaxially with respect to one another to define a generally annular space therebetween into which such a metal object is received when placed in said cell, the inter-electrode radial spacing between said interior and exterior electrodes being such that when such a metal object is received in said cell the space between the interior and exterior sidewall portions of such metal object and the respective said interior and exterior electrodes defines respective electrocoating medium reservoir portions of insufficient volume to complete an electrocoating process in the absence of continuous electrocoating medium flow, and supplemental reservoir means located on opposite sides of the respective said electrodes from said reservoir portions and communicating openly therewith through plural perforations distributed over the surfaces of the respective said electrodes whereby the combined capacity of said supplemental reservoir means and the respective said portions is sufficient to complete an electrocoating process without imposing continuous electrocoating medium flow within the cell.

* * * * *